United States Patent [19]

Glick

[11] 3,986,715

[45] Oct. 19, 1976

[54] RACKET CARRIED SCORING DEVICE

[76] Inventor: John C. Glick, 52471 Pheasant Run Drive, Saginaw, Mich. 48603

[22] Filed: Sept. 10, 1975

[21] Appl. No.: 612,000

[52] U.S. Cl. ..... 273/73 R; 116/135

[51] Int. Cl.[2] ..... A63B 49/00

[58] Field of Search ..... 273/3 R, 8, 9, 68, 73 R, 273/73 J, 81 R, 162 R, 162 A; 116/114 R, 120, 130, 131, 135; 235/91 B; 340/323; 35/31 E, 32, 33, 75, 76; 40/28

[56] References Cited

UNITED STATES PATENTS

| | | | |
|---|---|---|---|
| 434,425 | 8/1890 | Cooper | 273/73 R X |
| 448,878 | 3/1891 | Clarke | 273/73 R |
| 1,170,298 | 2/1916 | Lundy | 116/135 |
| 1,768,087 | 6/1930 | Leverson | 116/130 |
| 2,211,635 | 8/1940 | Barteaux | 116/120 X |
| 2,296,308 | 9/1942 | Rand | 116/130 |
| 2,759,666 | 8/1956 | Wyckoff | 116/120 X |
| 3,342,489 | 9/1967 | Waldo | 273/68 |

FOREIGN PATENTS OR APPLICATIONS

| | | | |
|---|---|---|---|
| 22,925 | 10/1913 | United Kingdom | 273/73 R |

*Primary Examiner*—Richard J. Apley

[57] ABSTRACT

A scoring device capable of being mounted upon the handle of a tennis racket has a pair of pad-like members, with a series of parallel grooves, which are adhesively mounted to opposite sides of the handle of the racket, the grooves extending in a direction normal to the longitudinal axis of the handle. A resilient band having a pair of beads at diametrically opposed positions on the band is stretched around the handle, the beads being conformed to be seated in one of the recesses of the respective pad members at opposite sides of the handle.

6 Claims, 3 Drawing Figures

FIG. 1
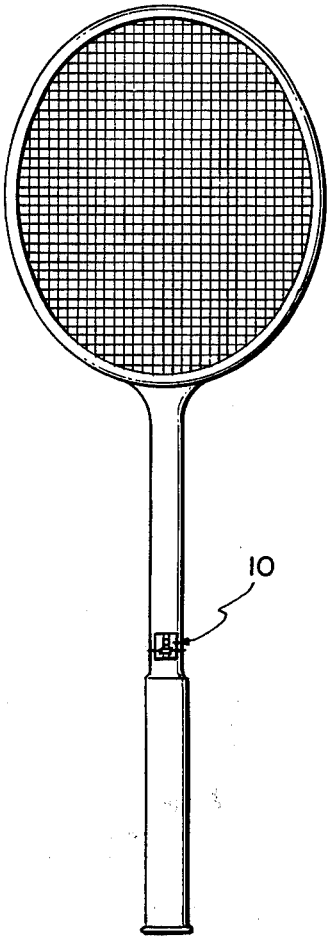
FIG. 2
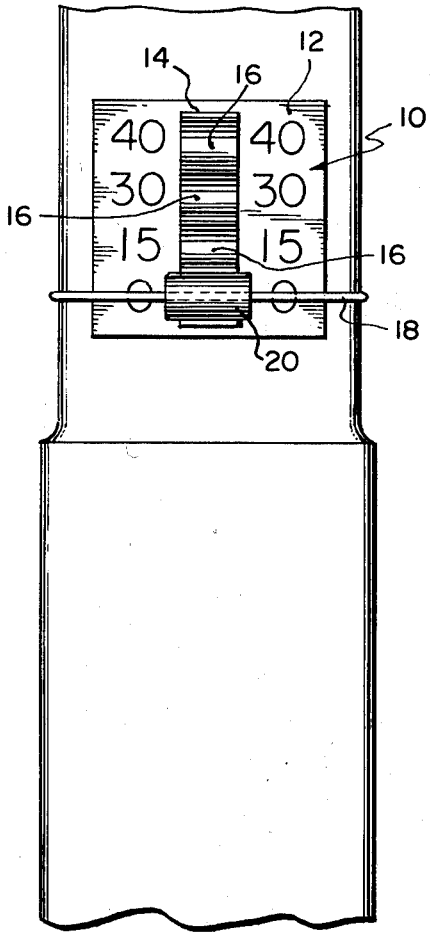
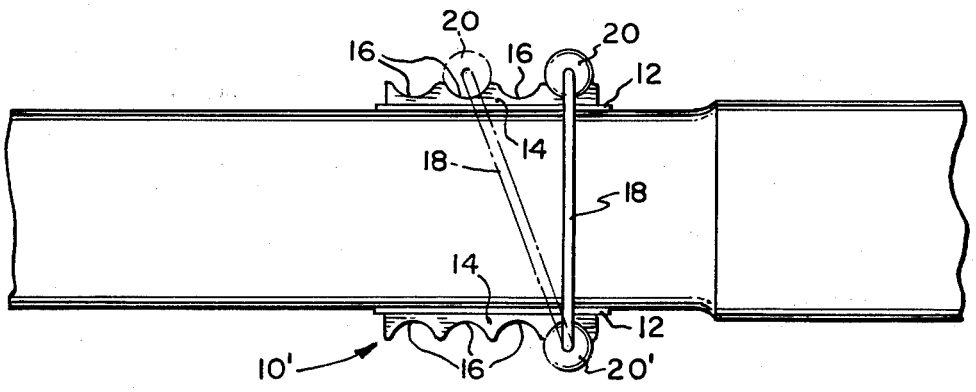
FIG. 3

RACKET CARRIED SCORING DEVICE

BACKGROUND OF THE INVENTION

The present invention is directed to the provision of scoring device for tennis especially designed to be ıounted directly upon the tennis racket, the device ·eing of negligible size and weight so that it presents no ıterference with the normal use of the racket and yet ; readily available for observation. In keeping with the ›bjectives of small size and negligible weight, the de-ice is of extremely simple construction while provid-ng readily visible scoring indications which are set by .n easily performed manual operation.

SUMMARY OF THE INVENTION

The device includes a pair of pad members which are ixedly mounted on opposite sides of the racket handle omewhat above the grip, as by an adhesive bond. Each ›ad is formed typically with four parallel notches or ;rooves which extend in a direction normal to the lon-;itudinal axis of the racket. Scoring indicia are dis-›layed adjacent each of the notches. The indicating ·lement takes the form of a resilient elastic band ıtretched around the racket handle and carrying a pair ›f bead-like members adapted to be seated in the ıotches or grooves in the pads. In use, the beads are displaced into the desired grooves on opposite sides of .he handle to indicate respectively the score of the ›layer and that of his opponent. One of the indicating ›eads or one of the pads may differ in color from the ›ther to identify which of the two bead-pad sets repre-ıents the opponents score.

Other features and objects of the invention will be-:ome apparent by reference to the following specifica-:ion and to the drawings.

IN THE DRAWINGS

FIG. 1 is a side view of a tennis racket carrying a scoring device embodying the present invention;

FIG. 2 is an enlarged detail side view of a portion of the racket handle with the scoring device in place; and FIG. 3 is a detail cross sectional view taken on the line 3—3 of FIG. 2.

The scoring device of the present invention includes a pair of like seating members designated generally 10 and 10′ which include a somewhat flexible sheet-like base portion 12 and a rigid pad 14 bonded to or integrally formed with base 12. Pad 14 is formed with a plurality of parallel grooves or recesses 16 which, when the pad 10 is mounted upon the racket handle, extend in a direction normal to the longitudinal axis of the racket handle. Scoring indicia — 0, 15, 30 and 40 — are applied to base 12 adjacent each of the grooves 16, as best seen in FIG. 2. In the embodiment shown in the drawings, four grooves 16 are employed, however, an additional groove 16 may optionally be included to indicate "advantage".

The indicator unit of the scoring device includes a resilient endless elastic band 18 dimensioned to be at least slightly stretched when the band encircles the handle. A pair of beads 20, 20′ are mounted upon band 18, at diametrically opposed positions. In the embodiment shown in the drawings, the grooves 16 are of semi-cylindrical configuration, while the beads 20, 20′ are of cylindrical shape dimensioned to be snugly seated in grooves 16. Band 18 has sufficient stretchability so that, as best seen in FIG. 3, when the bead 20′ is seated in one of the recesses 16 of pad 10′, the opposed bead 20 can be seated in any of the grooves 16 of pad 10, the band 18 resiliently retaining the beads in the grooves in which they have been placed.

Preferably the two beads 20 and 20′ are of different color so that one bead is identified as the indicating bead for the player's score, while the other bead is readily identifiable as indicating the opponent's score. Alternatively, the two pads 10 and 10′ may be made of different colors or have appropriate indicia applied to them to differentiate between the player's score and that of his opponent.

Operation of the scoring device is believed apparent in that the bead 20, if used to indicate the player's score, is shifted from one groove 16 to the next when the player wins a point, while the other bead 20′ is similarly shifted one step when the opponent wins a point. Shifting of the beads from one notch to the next may be simply accomplished by using the thumb to roll the bead from one notch to the next.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

I Claim:

1. In combination with a tennis racket or the like having a handle; a score-keeping device comprising a pair of seat members adapted to be mounted on opposite sides of said handle, each of said members having a series of spaced recesses therein extending in a row longitudinally of said handle, scoring indicia on said seat member identifying each of said recesses as representative of a particular score, a resilient endless band member, a pair of bead-like members mounted at diametrically opposite positions on said band member and adapted to be seatingly received within a recess in said seat member, said band member being operable to resiliently retain one of said bead members seated in one recess of one of said seating members when the other bead member is seated in any of the recesses of the other seating member.

2. The invention defined in claim 1 wherein each seating member comprises a pad-like member having a plurality of parallel semi-cylindrical grooves in one side thereof defining said recesses, and means for securing the opposite side of said pad-like member in face-to-face engagement with a side surface of said handle with said grooves extending in a direction substantially normal to the longitudinal axis of said handle.

3. The invention defined in claim 2 wherein said bead members are of generally cylindrical configuration.

4. The invention defined in claim 2 wherein the means for securing comprises an adhesive coating on said opposite side of said pad-like member.

5. The invention defined in claim 1 wherein at least one of said seating members and said bead members has applied thereto indicia distinguishing it from the other members.

6. In combination with a tennis racket or the like having a handle; a score-keeping device mounted on said handle, comprising seat means, with inner and outer faces, in engagement with the handle and facing outward respectively, said seat means having at least two series of facially outwardly open spaced recesses therein, disposed generally centrally on the seat means and extending in a row on said handle, tennis scoring indicia on said seat means identifying each of said recesses as representative of a particular score, resilient band means, and at least a pair of marker members mounted on said band means and adapted to be seatingly received respectively within a recess in each series of recesses in said seat means to indicate separate scores.

* * * * *